US010883708B2

(12) United States Patent
Chien

(10) Patent No.: US 10,883,708 B2
(45) Date of Patent: Jan. 5, 2021

(54) LED BULB HAS MULTIPLE FEATURES

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 2 days.

(21) Appl. No.: 15/348,218

(22) Filed: Nov. 10, 2016

(65) Prior Publication Data

US 2017/0059132 A1 Mar. 2, 2017

Related U.S. Application Data

(60) Continuation-in-part of application No. 15/296,599, filed on Oct. 18, 2016, now Pat. No. 10,228,112, and a continuation-in-part of application No. 15/170,071, filed on Jun. 1, 2016, and a continuation-in-part of application No. 14/983,993, filed on Dec. 30, 2015, now Pat. No. 9,909,739, which is a continuation of application No. 14/844,314, filed on Sep. 3, 2015, (Continued)

(51) Int. Cl.

| | |
|---|---|
| ***F21V 23/04*** | (2006.01) |
| ***F21S 8/00*** | (2006.01) |
| ***F21S 10/00*** | (2006.01) |
| ***F21V 5/04*** | (2006.01) |
| ***F21K 9/232*** | (2016.01) |
| ***F21K 9/65*** | (2016.01) |
| ***F21K 9/60*** | (2016.01) |
| ***F21V 14/02*** | (2006.01) |
| *F21V 29/502* | (2015.01) |
| *F21Y 115/10* | (2016.01) |
| *F21Y 113/10* | (2016.01) |
| *F21V 29/70* | (2015.01) |
| *F21W 131/30* | (2006.01) |

(52) U.S. Cl.

CPC ..... *F21V 23/0442* (2013.01); *F21K 9/232* (2016.08); *F21K 9/60* (2016.08); *F21K 9/65* (2016.08); *F21S 8/035* (2013.01); *F21S 10/00* (2013.01); *F21V 5/04* (2013.01); *F21V 14/02* (2013.01); *F21V 29/502* (2015.01); *F21V 29/70* (2015.01); *F21W 2131/30* (2013.01); *F21Y 2113/10* (2016.08); *F21Y 2115/10* (2016.08)

(58) Field of Classification Search

CPC ..... H04N 7/181; F21S 8/038; F21S 10/002; F21K 9/232; F21K 9/65; F21V 14/02; F21V 29/20; F21V 23/0442; F21V 5/04; F21V 21/08

See application file for complete search history.

(56) References Cited

U.S. PATENT DOCUMENTS 3,762,082 A 10/1973 Mincy
6,267,478 B1 7/2001 Chen (Continued)

*Primary Examiner* — Anabel Ton

(74) *Attorney, Agent, or Firm* — Bacon & Thomss, PLLC

(57) ABSTRACT

The current invention make a big improvement than conventional market available all kind of LED bulb which only can offer near-by areas illumination not like the current invention can use one LED bulb to offer near-by and far-away illumination or image or both or any combination with other light effects and digital data display images. Also, The current invention may has more than one light beam emit out from LED bulb which under more than one control means for the one of the light beam may selected from power failure, remote control, Infra red controller, bluetooth with mobile phone, motion sensor to trigger at least one of the light beam to offer the light beam for illumination or image to area(s).

14 Claims, 9 Drawing Sheets

Related U.S. Application Data which is a continuation-in-part of application No. 14/606,242, filed on Jan. 27, 2015, now Pat. No. 9,541,260, which is a continuation of application No. 14/503,647, filed on Oct. 1, 2014, now Pat. No. 9,719,654, which is a continuation-in-part of application No. 14/503,647, filed on Oct. 1, 2014, now Pat. No. 9,719,654, which is a division of application No. 14/451,822, filed on Aug. 5, 2014, now Pat. No. 10,047,922, which is a continuation-in-part of application No. 14/323,318, filed on Jul. 3, 2014, now Pat. No. 10,222,015, which is a continuation of application No. 14/323,318, filed on Jul. 3, 2014, now Pat. No. 10,222,015, which is a continuation-in-part of application No. 14/289,968, filed on May 29, 2014, now Pat. No. 9,551,477, which is a continuation of application No. 14/280,865, filed on May 19, 2014, now Pat. No. 9,581,299, which is a continuation-in-part of application No. 14/023,889, filed on Sep. 11, 2013, now Pat. No. 10,323,811, which is a division of application No. 13/540,728, filed on Jul. 3, 2012, now Pat. No. 8,834,009, which is a continuation of application No. 13/540,728, filed on Jul. 3, 2012, now Pat. No. 8,834,009, which is a continuation-in-part of application No. 13/367,758, filed on Feb. 7, 2012, now Pat. No. 8,967,831, which is a continuation-in-part of application No. 13/296,469, filed on Nov. 15, 2011, now Pat. No. 8,711,216, and a continuation-in-part of application No. 13/296,508, filed on Nov. 15, 2011, now Pat. No. 8,562,158, which is a continuation of application No. 12/938,564, filed on Nov. 3, 2010, now Pat. No. 9,239,513.

(56) References Cited

U.S. PATENT DOCUMENTS

| | | | | |
|---|---|---|---|---|
| 6,416,195 | B1 | 7/2002 | Lin | |
| 6,558,022 | B2 | 5/2003 | Kawahara | |
| 6,972,736 | B1 * | 12/2005 | Wada | G09G 3/20 345/32 |
| 7,056,006 | B2 | 6/2006 | Smith | |
| 7,358,929 | B2 * | 4/2008 | Mueller | E04F 13/08 345/1.1 |
| 7,736,020 | B2 | 6/2010 | Barocky et al. | |
| 7,748,869 | B2 | 7/2010 | Sevack et al. | |
| 7,789,532 | B2 | 9/2010 | Toriyama et al. | |
| 7,871,192 | B2 | 1/2011 | Chien | |
| 8,113,698 | B2 * | 2/2012 | Wu | F21V 29/004 362/249.02 |
| 8,128,259 | B2 | 3/2012 | Myers et al. | |
| 8,262,252 | B2 | 9/2012 | Bergman et al. | |
| 8,721,160 | B2 | 5/2014 | Chien | |
| 8,827,496 | B2 | 9/2014 | Vanderschuit | |
| 8,834,009 | B2 | 9/2014 | Chien | |
| 8,847,491 | B2 | 9/2014 | Yotsumoto et al. | |
| 9,081,269 | B2 * | 7/2015 | Conti | F21V 23/0435 |
| 9,107,248 | B2 | 8/2015 | Chen | |
| 9,134,012 | B2 | 9/2015 | Wu | |
| 9,206,952 | B2 | 12/2015 | Gold | |
| 9,217,555 | B2 | 12/2015 | Farmer | |
| 9,316,838 | B2 | 4/2016 | Chien | |
| 2010/0238672 | A1 | 9/2010 | Wu et al. | |
| 2011/0116266 | A1 | 5/2011 | Kim | |
| 2011/0134239 | A1 | 6/2011 | Vadai et al. | |
| 2014/0306599 | A1 | 10/2014 | Edwards et al. | |

* cited by examiner

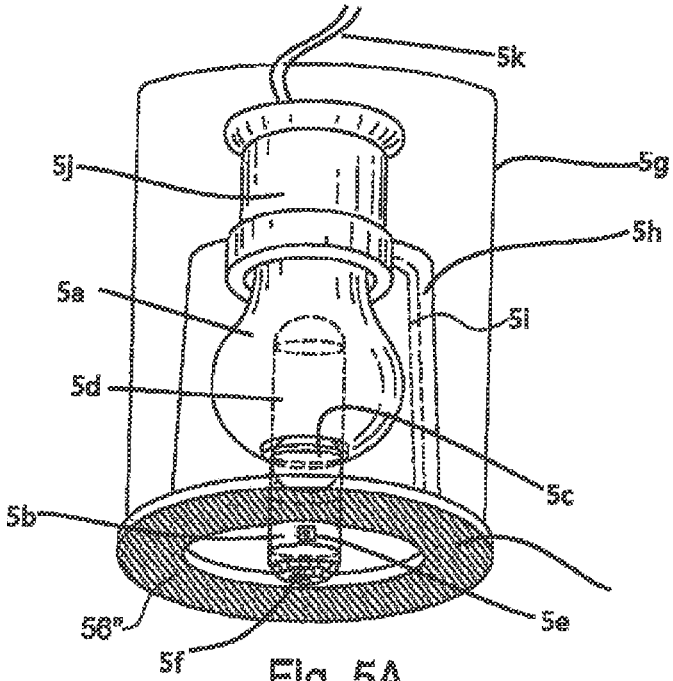
Fig. 5A
Fig. 5B
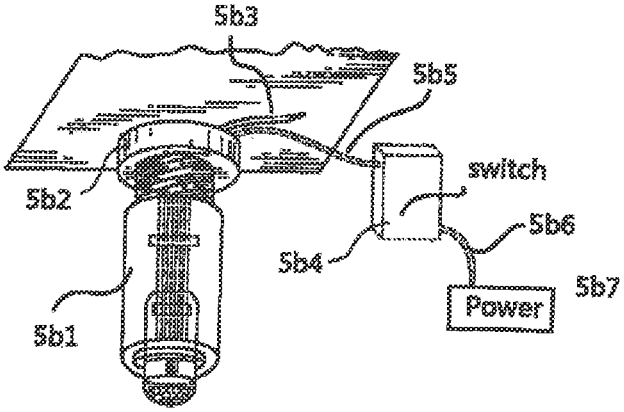
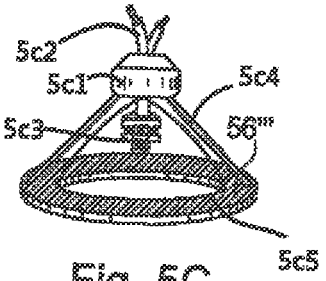
Fig. 5C
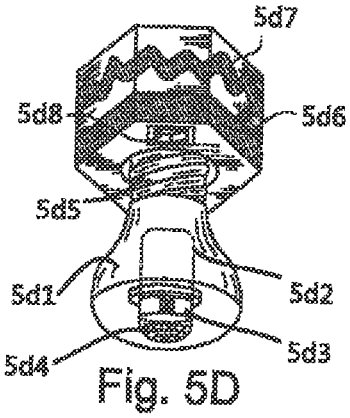
Fig. 5D

Fig. 7A
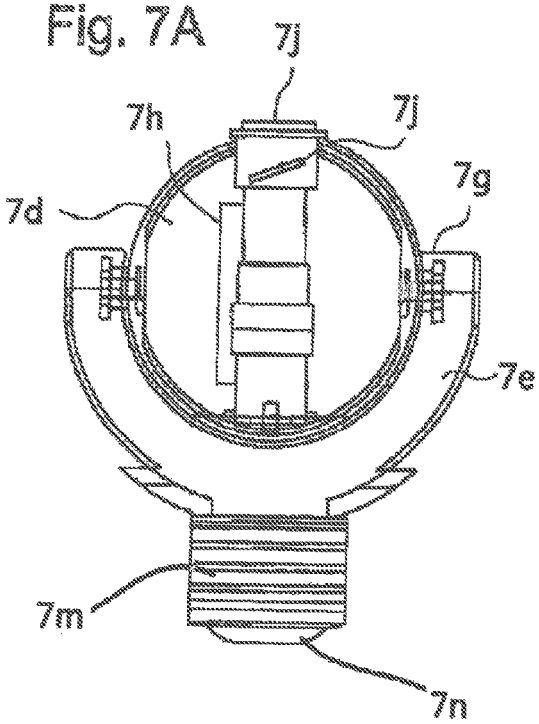
Fig. 7B
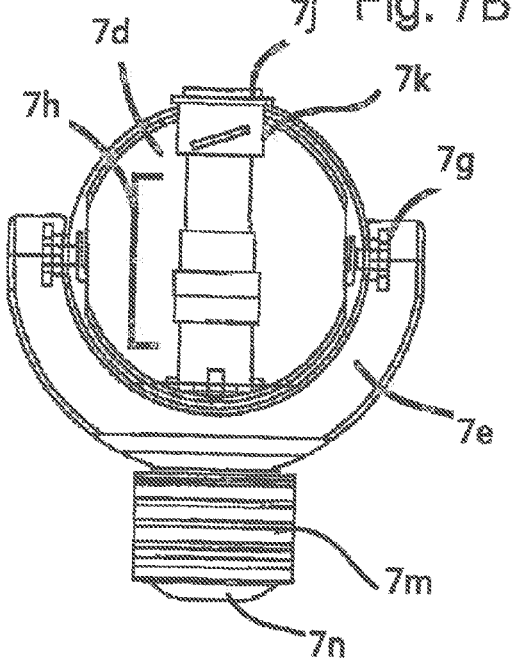
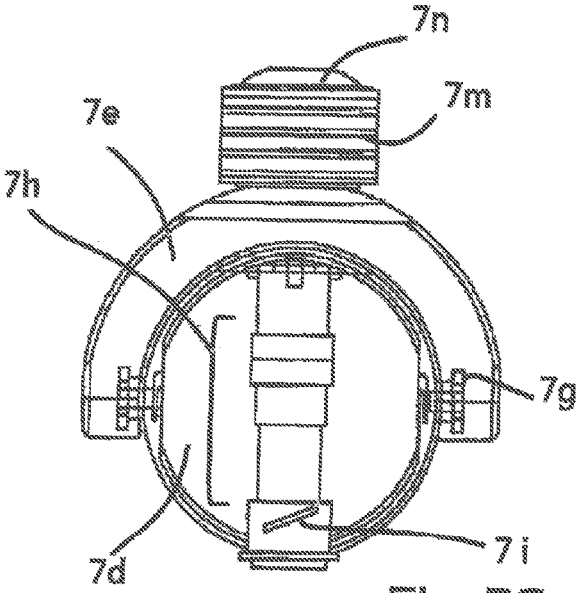
Fig. 7C
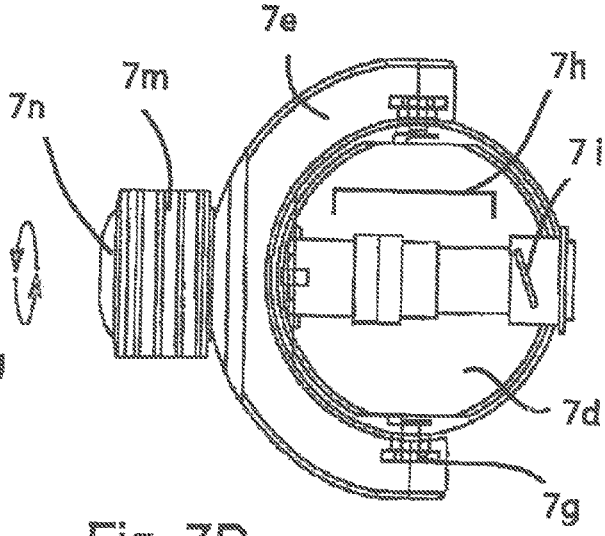
Fig. 7D

LED BULB HAS MULTIPLE FEATURES

This application is a continuation of U.S. patent application Ser. No. 13/540,728, filed Jul. 3, 2012, now allowed, which is a continuation-in-part of U.S. patent application Ser. No. 13/296,508, now U.S. Pat. No. 8,562,158, and Ser. No. 13/296,469, now U.S. Pat. No. 8,711,216, each filed Nov. 15, 2011 and incorporated herein by reference.

BACKGROUND OF THE INVENTION

The present application has subject matter in common with copending and patented applications of the inventor that are directed to (1) a projection light, (2) a device with more than one function, (3) an adjustable focus device, (4) an adjustable angle device, (5) elastic contact points, (6) an LED heat solution, (7) installation of heat sensitive parts, and (8) extension means. The copending and patented applications include U.S. patent application Ser. Nos. 13/367,758, 13/367,687, 13/296,508, 13/296/469, 13/295,301, 13/021,107, 12/950,017, 12/951,501, 12/938,564, 12/886,832, 12/876,507, 12/771,003, 13/021,124, 12/624,621, 12/622,000, 12/318,470, 12/914,584, 12/834,435, 12/292,153, 12/907,443, 12/232,505, 11/806,711, and 11/806,285. U.S. Ser. No. 13/295,301 is for a h device having built-in digital data means and powered by an unlimited power source of the light device. U.S. Ser. No. 13/296,508 is for a device having built-in digital data means and powered by an unlimited power source of an LED bulb. U.S. Ser. No. 13/296,469 is for a device having built-in digital data means and powered by an unlimited power source of a lamp holder. Finally, U.S. Ser. No. 12/951,501 is for a lamp holder having a built-in LED night light.

These applications are further related to the inventor's copending and patented U.S. Patent Appl. Ser. No. 13/162,824 (light device with display means, track-means, and removable LED-unit(s)), Ser. No. 12/938,628 (LED light fixture has outlet(s) and removable LED unit(s)), Ser. No. 12/887,700 (light fixture with self-powered removable LED unit(s)), Ser. No. 12/149,963 (now U.S. Pat. No. 7,722,230), Ser. No. 12/073,095 (now U.S. Pat. No. 7,726,869), Ser. Nos. 12/073,889, 12/007,076 (now U.S. Pat. No. 7,726,841), Ser. No. 12/003,691 (now U.S. Pat. No. 7,726,839), and Ser. No. 12/894,865.

The above-listed patent applications are further related to the inventor's copending or patented U.S. patent application Ser. Nos. 12/624,621, 12/622,100, 12/318,471, 12/318,470, 12/318,473, 12/292,153, 12/232,505, 12/232,035, 12/149,963, 12/149,964, 12/073,095, 12/073,889, 12/007,076, 12/003,691, 12/003,809, 11/806,711, 11/806,285, 11/806,284, 11/566,322, 11/527,628, 11/527,629, 11/498,874, 12/545,992, 12/806,711, 12/806,285, 12/806,284, 12/566,322, 12/527,628, 12/527,629, 12/527,631, 12/502,661, 11/498,881, 11/255,981, 11/184,771, 11/152,063, 11/094,215, 11/092,742, 11/092,741, 11/094,156. 11/094,155. 10/954,189, 10/902,123, 10/883,719, 10/883,747, 10/341,519, 12/545,992, 12/292,580, 12/710,918, 12/624,621, 12/622,000, 12/318,471, 12/318,470, 12/318,473, 12/292,153, 12/710,561, 12/710,918, 12/711,456, and 12/771,003.

The current invention is an LED bulb that may incorporate features described in the above-listed copending or patented cases of the inventor as well as related or equivalent features, functions, or replacement parts. Additional features of the invention include the following:

1. The LED bulb has the property that the LED bulb can twisted over an additional degree or twist angle after the LED Bulb's contact-point touches an electrode in the holder, enabling horizontal positioning over an angle of more than 360 degrees when positioning a light beam to desired area(s) to obtain a wider adjustment angle or wider range of adjustment directions, and with the additional feature of incorporating an adjustable focus means to cause the LED light beams or image to provide different light performances on any desired locations or area(s). The LED bulb may include a rotatable LED Ball with two arms so that an LED bulb of preferable geometric shape and construction may also have a vertical adjustment angle of up to more than 360 degrees so that the LED bulb's plurality of light beams can cover all x-y-z axis areas by at least one of light beam or a plurality of the light beams and illuminate both nearby and faraway or remote areas.

2. The LED Bulb may have one or more than one light source arranged in the LED bulb to provide a desired light performance as described in the inventor's copending U.S. patent applications, which describe a night light with more than one LED light source or LED projection assembly. A difference with respect to the prior arrangements is that a night light has prong means for outlet installation and does not have extendable/retractable means.

3. The current invention includes an LED Bulb with adjustable focus means to enable light beams from the same LED bulb to be emitted to any desired surface(s) with a desired light performance, including a desired brightness, size, light spots, color, or lit-areas. The same light beam output from the same LED bulb with focus adjustable means enables a user to create different light patterns, light paths, light brightness, light performance, and light direction.

4. The LED bulb of the current invention has extendable means, such as an extension tube, telescope tube or equivalent extendable and receivable means that enable the electric parts and accessories of the LED bulb to keep away from the LED's heat, and away from any light blocking-means in the LED bulb, such as a curtain, shade, glass, recess lighting cylinder tube, or other blocking-means that would otherwise block a motion-sensor lens, remote control signal, or light beam emission direction, the extendable means further keeping the LED bulb's circuit board/control means/IC means/switch means/sensor means/electric parts or assembly means away from the LED-units to thereby prevent heat from affecting desired functions or performance, such as the performance of a motion sensor, PIR sensor head, Fresnel lens, or LED-unit light beam emitting direction.

5. The LED bulb of the current invention may have an extractable/extendable/movable means to put heat sensitive or light sensitive parts away from the LEDs' heat, light shade, curtain, glass, decorative material, ceiling blocking means, or any other light blocking means that might interfere with operation of the LED bulb or LED bulb's related parts and accessories. The extendable or extractable means preferably being situated at the front of the LED bulb, although the position will depend on the different requirements and different considerations with respect to heat and light blocking-means, and the ability to offer more space to install the preferred electric parts and accessories, the extra length provided by the extractable/extendable/movable means having the effect of moving sensitive parts far away from the heat source or blocking means so that the LED bulb can overcome the effects of heat and blocking means for any application or installation.

6. The current invention is different from all market-available LED bulbs which offer illumination that only covers an adjacent area starting from the LED Bulb to a certain distance (illumination surrounding the LED bulb) and do not offer illumination or images in areas in certain directions, angles, and distances that are faraway or remote from the LED bulb. The current invention offers any combination of nearby area illumination and faraway area illumination.

7. The current invention provides an LED bulb that may have more than one light beam output to different areas, directions, and locations, including areas that may not be adjacent, linked, or situated together. By offering illumination of more than one area, the invention allows people to save energy by providing illumination exactly where needed. For example, stair lighting only requires up-or-down two-direction illumination. Rest areas do not need light at all, and the stair-lighting may further have a built in motion sensor having sensitivity up to 10-30 feet, which is enough to cover one flight of stairs (normally is 18 steps). One light beam from an LED bulb can reach nine steps going up and one light beam from the same LED bulb can reach nine steps going down. This is enough illumination because each UP or DOWN stair are been illuminated by each floor's one LED bulb, with two different of light beams covering nine steps up and nine steps down. This provides pretty a good power saving device while the motion sensor device ensures that only one of the two light beams needs to be output from the LED bulb at any one time.

Hence, the current invention can output at least one or a plurality of light beams from one LED bulb to nearby areas, remote areas, faraway areas, or any combination of these areas with adjustable angle, adjustable focus, elastic contact points, a rotate/spin/tilt frame or support or base to obtain a desired light beam emission direction, and extendable/retractable means to install all parts and accessories away from heat or blocking means, thereby providing a lighting device that lets all light beams be emitted to areas where they are needed for illumination, unlike conventional LED bulbs that can only illuminate nearby areas which start from the LED-bulb to a certain limited distance areas (conventional LED bulbs have insufficient brightness to emit light over long distances unless an optics lens or lens assembly is provided to project light beams to remote or faraway distances which the current market items cannot accomplish).

BRIEF DESCRIPTION OF THE DRAWINGS

FIGS. 5A, 5B, 5C, and 5D show examples of surrounding area's blocking means that can block out a light beam or electric-signal delivery direction.

FIGS. 7A, 7B, 7C, and 7D show different configurations of the LED ball for top/side/down installation so that the LED bulb(s) still can emit the light beam(s) to wherever needed. In addition, in this embodiment, any one of the LED light beams can present different light patterns by applying an adjustable focus means to one of the light beams in order to vary the size, brightness, location, distance, clearance, or even color (by adding a filter or other optics means) to the light beams.

Figure 1:
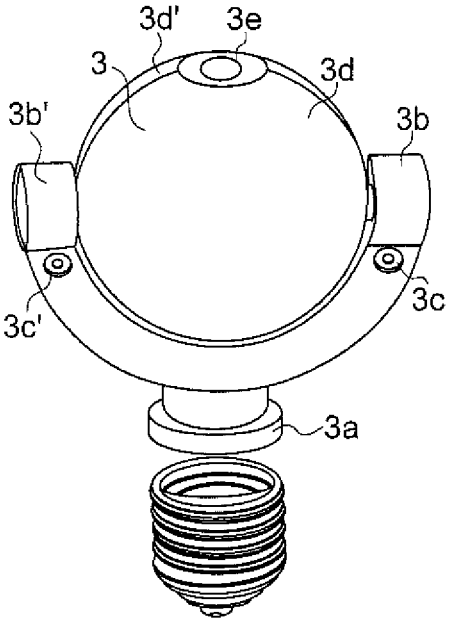
FIG. 1 shows a first preferred embodiment of an LED bulb having a ball shaped unit with two arms to join with a frame (having any shape or design) to enable the ball to rotate by more than 360 degrees, with a base that is in the form of a screw base of a male type assembly that is screwed into a female receiving part for power supply.

The current drawings are identical to those in the above-listed copending or patented applications, but with changes to the input end of the power source or power signal, so one can easily refer to the above applications for additional details of the LED bulb applications. It will be appreciated that any LED bulb concepts described in the copending or patented applications of the inventor, as well as same or equivalent-function concepts and, features may still fall within the scope of the current invention for LED bulb applications.

DETAILED DESCRIPTION OF THE PREFERRED EMBODIMENTS

From the above background and drawing discussion, those skilled in the art will appreciate that the current invention offers a big improvement over conventional market-available LED bulbs that can only offer nearby area illumination, unlike the current invention that can use one LED bulb to offer nearby illumination, faraway illumination or image projection, or both.

Also, the current invention provides for emission of more than one light beam from LED bulb, and more than one control means for selecting the light beams for different conditions or functions, such as power failure, remote control, infrared control, blue-tooth communications with a mobile phone, and motion sensing to trigger at least one of the light beams to illuminate or project an image to selected areas.

Additional features and embodiments are as follows:

Feature 1: The LED bulb may consist of at least one LED as a light source that emits light beams to desired areas or locations with predetermined illumination, function, time period, and performance. The LED bulb may further have parts or accessories that allow for projection and adjustment, including optic means, a lens, an adjustable focus means, twist means, rotate means, an elastic contact end, more than one output light beams, a rotating frame, a bulb shade with arms for enabling rotation, a twist bulb base, support for a shade, an LED assembly, LED tubular means, adjustment means, projection means, digital data display means, LCD display means, digital camera means, data storage means, data projection optics means, sensor means, switch means, IC means, circuit means, extend means, extractable means, filter means, stencil means, cutout means, painting means, motion sensor means, remote control means, blue-tooth means, and Internet wireless means, to enable the LED bulb to emit the light beams, images, time, data, digital messages, and Internet data as desired to nearby areas or remote distance areas for illumination.

The LED bulb connects with a power source by contact means in the base to enable the LED bulb to emit light beams to areas with an adjustable angle coverage, preferably in any direction relative to an x-y-z axis coordinate system, or any combination as required for preferred light performance, effects, and functions.

Furthermore, the direction of at least one of the output light beams from the LED bulb can be adjusted to a certain area, location, distance when adjusting the above-listed component(s) of the LED bulb.

The base of the LED bulb may be in the form of male insert means to fit into the female receiving means for a desired construction.

The said LED Bulb at least has adjustable parts to enable the at least one light beam to change position, direction, or orientation.

Feature 2 The LED bulb as above listed (Feature #1), may be provided with an elastic contact means which allows the LED bulb to adjust the light beam position, location, and direction to certain areas in three dimensions.

Feature 3: The LED bulb as above listed (Feature #1) may include extendable, extractable means to enable parts to be extended away from the LED Bulb and that have a configuration and construction that allows installation of some electric parts and accessories, sensor means, motion sensor means, remote control means, heat sensitive means so as to overcome heat and the blocking effects of a lightshade, lens, curtain, glass, cover, cavity depth, or any other blocking means that might interfere with operation of the LED bulb.

Feature 4: The LED bulb as above listed (Feature #1) can incorporate optics means, an optics lens, or an optics lens assembly with parts and accessories that cause the same light beam to have different light performance.

Feature 5: The LED bulb as above listed (Feature #1), may include a focus adjustment means that enables the same light beam to present different light performances at certain locations, positions, and areas with desire brightness, size, and performance.

Feature 6: The frame and support means of the LED Bulb as above listed (Feature #1), may be arranged to enable the bulb to twist, tilt, rotate, spin, and angle-adjust with hold means to overcome any heat issues and facilitate a change in the desired angle.

Feature 7: The base of the LED bulb as above listed (Feature #1), can have any construction including screw type, pin type, poles type, multiple pole type, twist type, and bayonet type construction.

Feature 8: The LED bulb as above listed (Feature #1) may have more than one light beam output so as to emit more than one light beam to locations, areas, and positions that are remote from the LED Bulb.

Feature 9: The LED bulb as above listed (Feature #1) may include an LED tube means that serves to prevent light leakage from the projection means and ensures that LED light beams passing through the optics means, optics lens, display unit, image forming means, LCD display, Lcos image, and/or digital display of the projection means can be emitted out of the LED Bulb to desired locations, positions, and areas.

Feature 10: The LED bulb as above listed (Feature #1) may include any of a sensor means, switch means, motion sensor means, remote control means, blue-tooth means, photo sensor means or other market-available electric parts and accessories incorporated with circuit means to cause the LED light source to emit light so as to provide predetermined light functions, performance, and effects.

Feature 11: The extension or retractable means of the LED bulb as above listed (Feature #1) can be installed with select electric parts and accessories, with the LED light source being arranged in the LED bulb in an up, down, or horizontal arrangement.

Feature 12: The LED bulb as above listed (Feature #1) can illuminate any combination of nearby or faraway areas to provide both nearby and faraway area lighting effects.

Feature 13: The LED bulb as above listed (Feature #1) may have more than one function that not only offers illumination for nearby areas or remote distance areas, but that also may incorporate motion sensor, remote control, blue-tooth, and other functions.

Feature 14: The extendable and retractable means of the LED bulb may include any heat-sensitive or light blocking-means-affected circuit means, IC means, electric parts and accessories, switch means, sensor means, remote control means, blue-tooth means or equivalent trigger means, extra LEDs, RF receiving means, IR sensor means, or other control means to overcome the effects of the LED's heat or surrounding blocking-means such as a lighting fixture's shade, cover, glass, frame, support, ceiling, wood piece, metal piece, or plastic pieces. The extend means can extend to a certain distance away from the LED's heat or any blocking-means so that the blocking means will not interfere with delivery of the light beams or electric signal delivery direction that might affect the pre-determined functions, performances, and effects of the LED bulb.

Feature 15: The LED bulb may include angle, position, orientation, direction, or focus-adjust means incorporated with optics means, an optics lens, a projection assembly, or an LED assembly. The LED bulb emits the light beam to desire areas in a preferred combination of nearby illumination, faraway illumination, nearby image projection, or faraway image projection, the projection including projection of a digital data image, movie image, internet digital data image, time display, motion picture image, or colorful image.

Feature 16: The LED light beam of the preferred LED bulb may further be triggered by control means which may be selected from one or more of a motion sensor, remote control, infrared sensor, blue-tooth means, power failure means and built-in direct current power storage means, sensor means, switch means, or other electric parts and accessories.

The following detailed description of the drawings include subject matter that was originally included as notes in the original drawings:

FIG. 1 shows a first preferred embodiment of the LED bulb of the invention having a ball-shaped unit with two arms to join with a frame (preferred any shape design) to enable the ball to rotate by more than 360 degrees in order to adjust a projection angle.

From FIG. 1 show the LED bulb (3) has project function and emit the project mage from optics-lens (3*e*) and illumination form the LED housing (3*d*) to desired direction. The ball (3*d*) is install on desired frame which can be rotate desired degree up to 360 degree on vertical axis and has frame base (3*a*) which also can offer rotate up to 360 on y-axis so project light can be any position or orientation as wish. The LED bulb (3) has the male conductive base which can be a screw-in thread base to install on the female bulb-socket or the base is injection piece with wire to connect with power source. The power source can be directly AC and change the inner or outside separated AC-to-DC circuit or transformer so can offer the DC current for LED and other DC-to-DC circuit to offer desired current or control signals to said related LED or sensor or switch for examples the project and illumination changeable by turn-on or turn-off switch so can change from project light to illumination light. Or by switch or sensor or remote control to change brightness, offer dimmer, color changing, selected color, moving effects, chasing, fade-in and fade-out or market available LED light functions all should cover within the current LED bulb scope. The base is in a form of a screw base of male type for assembly with female receiving parts that supply power.

Figure 2:
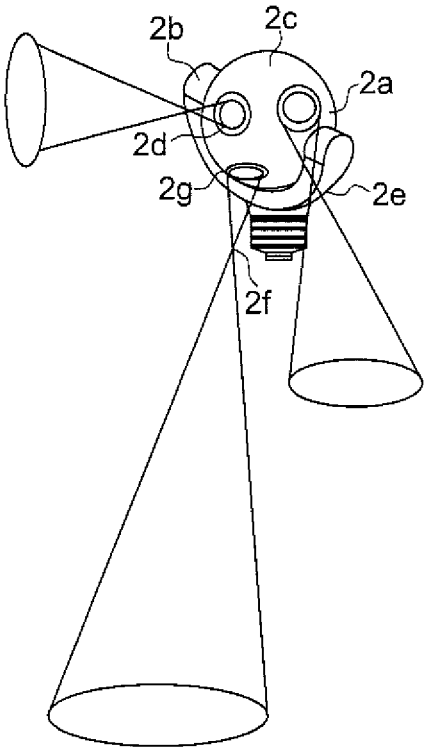
FIG. 2 shows the manner in which the first preferred embodiment of the LED bulb emits a plurality of light beams out from the ball shape body to different areas that are far away from the LED bulb through the use of an optics lens or optics means to get a desired light performance.

FIG. 2 shows the manner in which the LED bulb of the first preferred embodiment emits light from the ball shape body to different areas far away from the LED bulb using an optics lens and projection-assembly sets to help get a desired light performance. From FIG. 2 show the LED bulb selected the one of preferred construction has a ball (2*c*) and frame (2*e*) has more than one of project-assembly (2*a*), (2*d*), (2*g*) fit within the ball (2*c*) so can offer the multiple areas illumination (2*e*), (2*f*) to project the light beam or lighted patterns or lighted image depend on whether has the image-carriers incorporate with the said project-assembly. The said LED bulb has the also built-in more than one LEDs may selected from market available type and color and wattage or brightness incorporated integrated IC or circuit to created not only project light from project assemblies (2*d*), (2*e*), (2*g*) but also illumination from ball 2*c*.

Figure 3A:
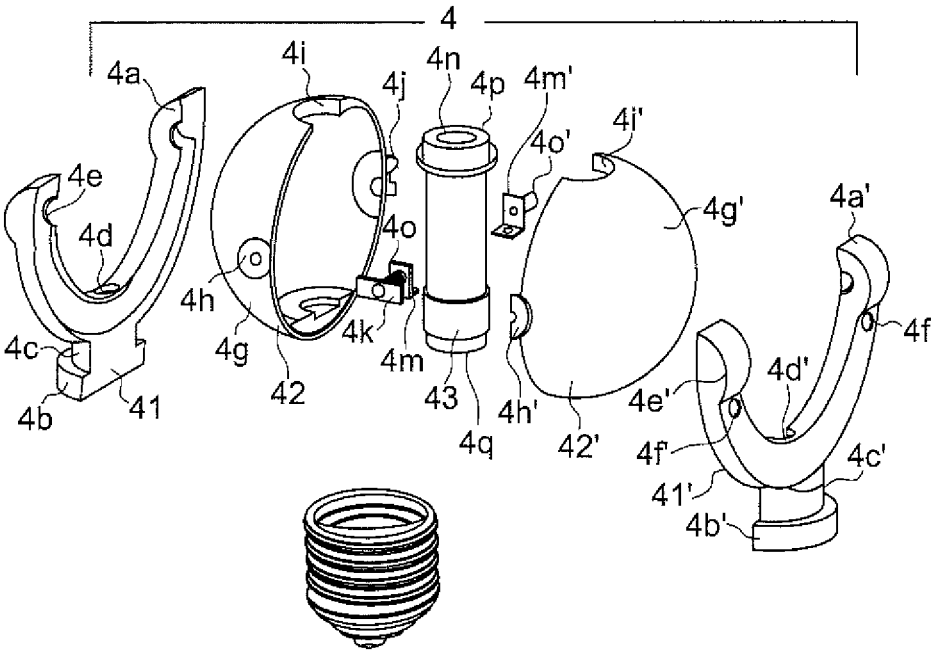
FIG. 3A shows details of the construction of the first preferred embodiment of the LED bulb, including projection means, optics means, a lens, metal conductive means, a rotating frame, a rotatable base, and a screw base that enables adjustment of an angle of the LED bulb.
Figure 3B:
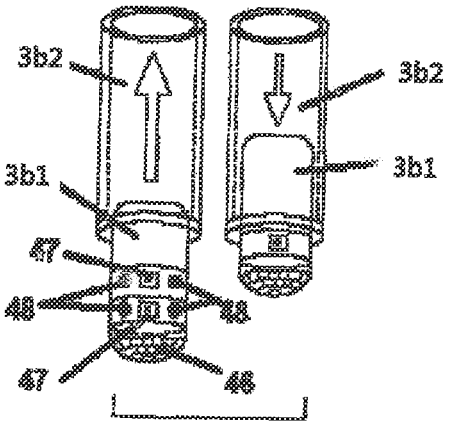
FIGS. 3B, 3C, 3D, 3E, 3F, 4A, FIGS. 4B, and 4C show a second preferred embodiment having extend means at the front to allow some heat-sensitive parts, a motion sensor, remote controller receiver parts, blue-tooth parts, an extra LED(s), digital recording means, track means, auto moving motors means, and other electric parts and accessories to be moved so as to overcome the effects of the LED's heat or of blocking means (such as the lighting fixture's shade, curtain, cover, glass, plastic piece, wood piece, or metal piece) that might block electric signal or light beam delivery directions, the extend means having a sufficient length to overcome the heat and blocking means.
Figure 3C:
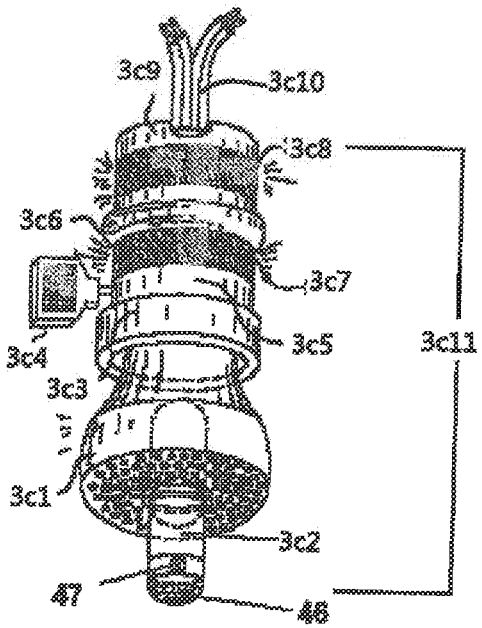
Figure 3D:
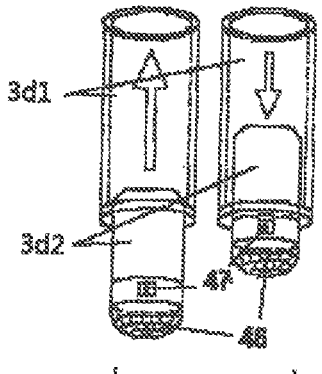
Figure 3E:
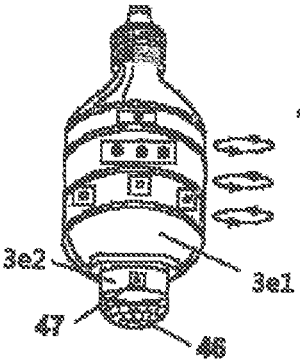
Figure 11A:
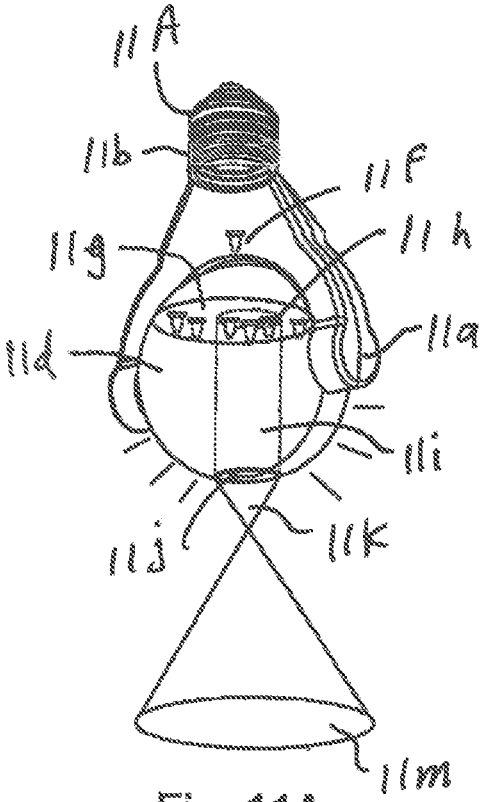
FIGS. 11A, 11B, and 11C show a preferred embodiment which can offer nearby and remote area illumination or images at the same time. The plurality of LEDs light sources are arranged inside the projection assembly, which includes telescope means, tubular means, and extend means for remote or faraway illumination or image projection. Some of LEDs provide high power output while others provide low power output to offer nearby illumination or images comparable to those of a normal current-market LED bulb or incandescent bulb.
Figure 11B:
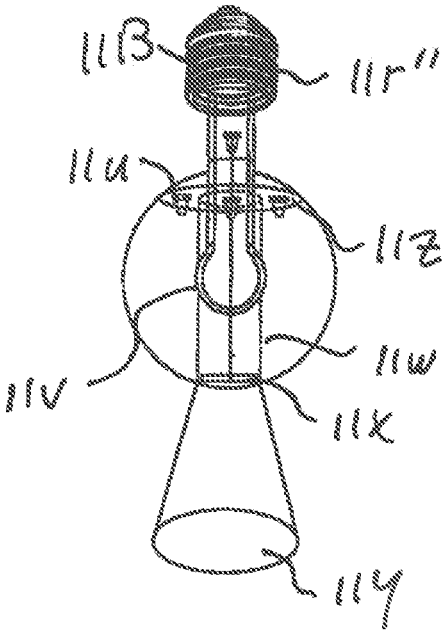

FIG. 3A shows further details of the first preferred embodiment, including project assembly (4*p*), geometric or desired shape of optics lens with preferred focus adjust kits (4*n*), other type of dome-shape lens (11*v*) of FIG. 11B, metal conductive piece here as screw-in male base or the wire, a rotating frame (4*a*) (4*a*'), rotatable base (4*b*)(4*b*'), and a screw base to enable adjustment of the projection light angle at which light beams are emitted by the LED bulb (4).

FIGS. 3A, 3B, 3C, 3D, 3E, 4A, and 4B show a second preferred embodiment having extendable and retractable parts (3*b*1, shown in FIG. 3B) in front to allow some heat-sensitive parts such as a motion sensor, remote controller receiver, or blue-tooth means 46, camera(s) 47, other sensor(s) 48, or extra LED(s), digital recording device means, track sets means, auto moving motors means or other preferred electric parts and accessories (Not shown) to be installed within and moved to overcome the effects of the LED's heat or the effects of blocking-object(s) means (13) such as a lighting fixture's shade, curtain, cover, glass, plastic piece, wood piece, metal piece that would otherwise block an electric signal or light beam delivery direction. As shown in FIG. 5A [3B], the blocking-objects such as wall (5*g*) or cylinder metal housing (5*i*) means (13) is in the form of an LED recess light cylinder housing (5*i*) which block the sensor, camera or wireless delivery of LED bulb. cover, which From FIG. 3C, the said LED bulb (3*c*1) is plugged into a socket (3*c*3) including additional illuminating elements (3*c*7) and (3*c*8), sensor means (46), and rotatable housing elements (3*c*5) and (3*c*6). The LED bulb (3*c*11) can be in one unit which (3*c*1) (3*c*5)(3*c*6)(3*c*7) is one injection piece with wire (3*c*10) to work as individual LED bulb for outdoor patio light application which can have outside or built-in switch for pre-set on-off times to change the projection or illumination light function, brightness, color changing or control by remote controller to had projection or-and illumination desired light effects or functions while the LED bulb (3*c*1) the front optional parts is extendable or fixed design with project-assembly fit within without the sensor or camera or other above mentioned wireless-receiver.

From 3D, show the extendable parts for LED bulb to overcome block-object(s) or heat-parts or interfere electric-signal delivery parts for some application. The said extendable parts (3*d*2) can move and stay on desired height and the top or whole extendable parts (3*d*2) can fit for sensor (46) or camera (47) or wireless signal receiver (not shown) or project-assembly.

From 3E, show the LED bulb (3*e*1) has multiple level and each level can add the different electric parts with the front extendable or fixed or non-movable head parts (3*e*2) to make the desired projection, and the other front surface of LED bulb (3*e*1) can emit the desired LED light beam for illumination.

Figure 3F:
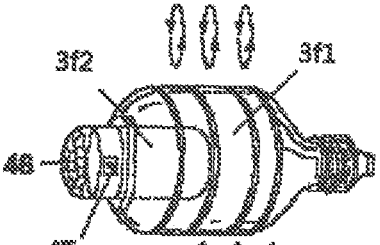

From FIG. 3F show the LED light (3*f*1) had extendable head-parts (3*f*2) which has built-in desired sensor (46) or camera (47) or wireless signal receiver (not shown) or project-assembly head (not shown) with multiple levels has desired functions.

Figure 4A:
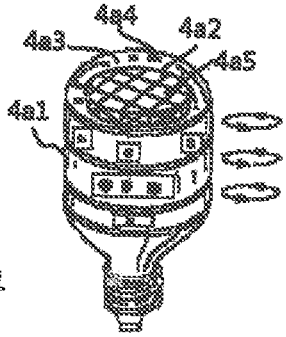

From FIG. 4A shown the same as FIG. 3F has no extendable-parts and the project-assembly (4*a*2) is a big-size optic lens which has desired optics-property or texture or treatment such as diamond-cut (4*a*5) on sphere or flat or other geometric shape with or without inner $2^{nd}$ optics-lens (not shown) to make multiple-times or more exciting or more complicated lighted patterns for upgrade product(s) to project out from LED bulb (4*a*1) connect with inner motor or rotate sets to make the big-optics lens which has preferred optic-properties including reflective or-and refractive lens to project the splendid, colorful, bright, lighted patterns with moving or rotating effects through the moving or rotating or fixed big size optics-lens of project-assembly (4*a*2).

Figure 4C:
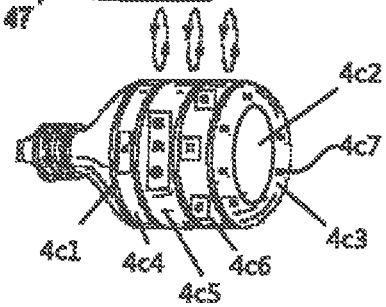
Figure 4B:
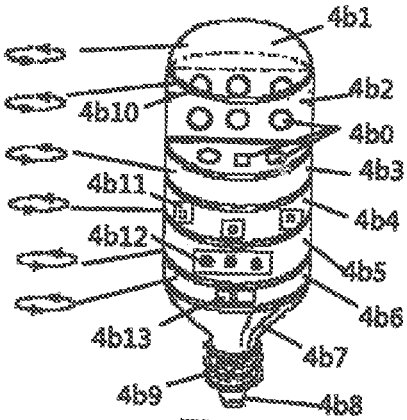

From FIG. 4B shown the multiple levels LED bulb which has top big size of project-lens (4*b*1) which can project like FIG. 4A shown and desired changing or moving of colorful lighted-pattern. The said illumination will be from the side of the top portion of LED (4*b*2) with built-in desired type of LEDs (4*b*0) to offer illumination. The optional to add more level (4*b*3), (4*b*4), (4*b*5), (4*b*6) can add-on desired number of the other electric functions with optional rotating features.

From FIG. 4C shown the same as FIG. 4B with less levels to show the concept and the top of the LED bulb (4*c*3) has center project light assembly (4*c*2) and surrounding the plurality of LEDs (4*c*7) for the illumination purpose.

FIGS. 5A, 5B, 5C, and 5D show examples of some of the surrounding area's blocking-means that will block light beam or electric-signal delivery direction, and that can be overcome by the extend means of the preferred embodiment.

From FIG. 5A show the LED bulb (5*a*) apply to the recess light device which is deep inside the ceiling and surrounding by wall (5*g*) and cylinder metal housing (5*i*) that install into ceiling wall (5*h*). The said LED bulb (5*a*) has optics-lens for desired size and shape and optics-properties to make the inner LED light single white color LED for projection light source or more than one color for illumination function(s) to emit out from top of the movable or rotating parts (5*d*) and offer the bright illumination from the rest of parts of LED bulb (5*a*). The said extendable parts (5*d*) can optional added the other electric function units including camera (5*e*) or sensor (5*f*) while people not use the movable parts (5*d*) for projection light functions. The recess light may has decorative ring (56") for cosmetic. The said LED bulb (5*a*) has wires and receiving socket (5*j*). It is appreciated the said receiving socket (5*j*) and bulb housing (5*a*) can injection together in one piece as above discussed so it will become one unit with wire to make light string for patio LED bulb string applications.

From FIG. 5B shown LED bulb (5*b*1) has built-in extendable or non-movable parts for projection and illumination light or-and the camera or sensor kits which fit into receiving socket (5*b*2) and wired (5*b*3) with the functional changeable switch control box (5*b*4) or other circuitry with wired or wireless controller which can change projection or illumination light functions such as change from projection to illumination, change illumination color, select illumination color, dimmer the illumination brightness, turn-on and turn-off light source. The wires (5*b*5) and (5*b*6) to connect the power to switch control-box and to socket or directly to one unit LED bulb (5*b*1) to link with injected one unit LED bulbs to form a light string for patio application.

From FIG. 5C shown the one unit of LED bulb (5*c*1) has built-in circuit inside and has front part for projection-assembly and illumination parts (5*c*3) to form one injected piece of LED-bulb, and rear-end has wires to connect with or injected with other one-unit LED bulb to form a light string. The said light string can assembly with housing (5*c*4) or further has front decorative piece (5*c*5). The said housing (5*c*4) or decorative piece (5*c*5) can be any market existing items shape so can apply the plurality number of one-unit LED bulb light string to fit for garden light or outdoor light or patio light application which depend on what kind of housing (5*c*4) and decorative parts (5*c*5) to assemble together with one-unit injected LED bulb.

From FIG. 5D shown the said LED bulb has project and illumination at least 2 functions which can be assembly with receiving socket (not shown) or the LED bulb is one injected-unit only connect with power source by wire (FIGS. 11A, 11B. 11C) while the LED bulb is one type or injected-piece or injected-unit to form a light string application. The said one-unit injected piece which means the screw male base change to non-screw type injected piece (5*d*5) and assembly the injected plastic housing (5*d*1) with bulb and has built-in LED light source and circuit or conductive to work with circuit for turn-on or tune-off. The said one unit injected LED bulb to inject together with others can form a light string. The said light string has its own circuit to response to the switch pre-determined IC program to make the Injected LED bulb or screw-in LED bulb to change from projection to illumination or to both functions or other desired LED light functions.

Figure 6A:
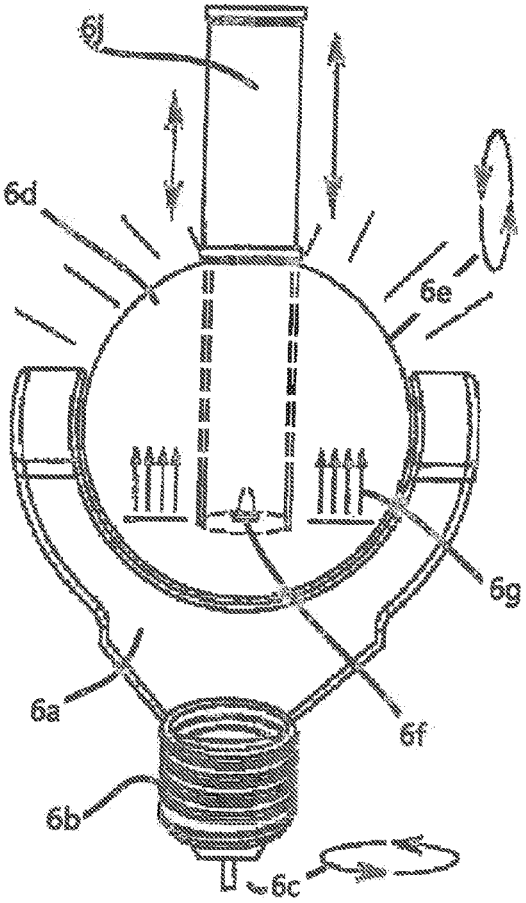
FIGS. 6A and 6B show a third preferred embodiment, including details of the LED's heat flow and the manner in which the extend means overcomes the LED's heat and blocking means, and also a rotating frame and base that allows light beams to be emitted in any direction of an x-y-z axis coordinate system without the need for an elastic contact point of the base.
Figure 6B:
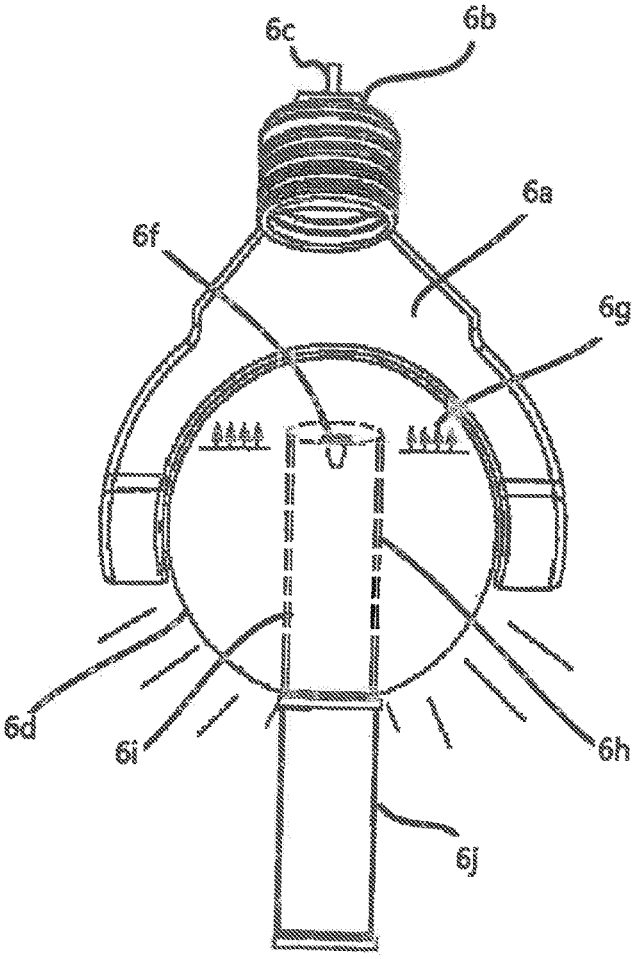

FIGS. 6A and 6B show a third preferred embodiment which shows details of the LED's heat flow and the manner in which the extend means overcome the LED's heat flow and the effect of blocking-means, as well as a rotating frame and base that allow the light beams to be emitted to any direction in three dimensions without any problem, or even the need for an elastic contact point of the base.

From FIGS. 6A and 6B shown the heat flow (6*g*) (6*f*) (6*g*) is always toward top of the said LED light. The LED bulb (6*a*) (6*d*) for screw-in or injected-one-unit with extendable or fixed project-assembly (6*j*) has desired diameter, lens size, lens optics-properties to project the light beam or lighted patterns. The rest of the LED bulb housing surface offer the illumination. The said LED bulb can be fixed bulb-ball or rotating in vertical or horizon or desired axis for x-y-z depend on market required. The said the LED bulb has pin-contact (6*c*) which has elastic functions so can make the people to twist more circles in horizon-axis and incorporated the current invention for rotatable LED bulb in vertical-axis so can let the LED project direction to anywhere of the area. It is appreciated the alternative or equal function or replaceable skill for LED bulb has at least one of a built-in or add-on adjustment kits selected from; (a) flexible hose, (b) bendable tube-like arm, (c) snake hose, (4) bendable bar; each having a bulb-socket and bulb-base on opposite ends, to change a LED bulb light emitting direction or overcome blocking elements and provide a desired light emitting direction and/or good electric signal transmission and/or reception, FIGS. 7A to 7D show different installations of the LED ball in top/side/down orientations so that the LED Bulb(s) still can emit light beam(s) to wherever needed. Other features are that any one of the LED light beams can present different light pattern(s) while apply the adjustable focus kits (7*k*) and circuit (not shown) or IC unit (not shown) can have a different light performance, including different size, brightness, location, distance, clearance, or even color when adding a filter or other optics means.

From FIG. 7A to 7D show the LED bulb has desired project-assembly (7*h*) which can be any number or any kind of tube or tubes or housing parts or holder to assembled together to prevent LED or-and laser light source light beam to leakage out while travel from LED to project output-end. The project-assembly (7*h*) has to make project light beam separated with the illumination light beam by housing-parts or tube so each one do not interfere with the projection and illumination functions. From FIGS. 7A to 7D shown the focus adjustable-kits which has simple or few thread to move the project-lens (7*j*) change the distance with the image-forming film or slide or cutouts (7*i*) or change the distance with the light source to make the lighted image or light-patterns or light beam has adjustable focus to get the best viewing result as wish.

Figure 8A:
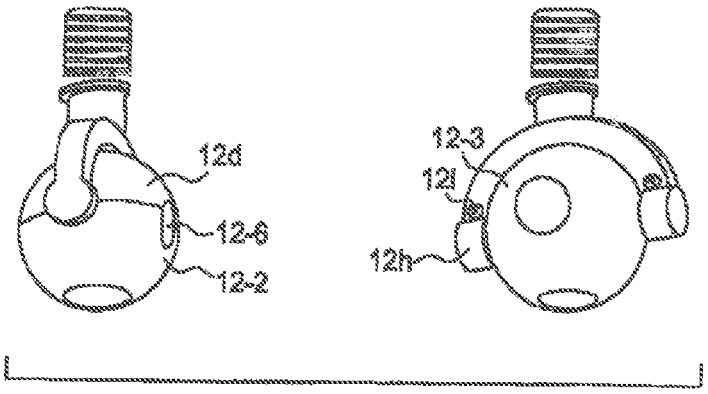
FIGS. 8A, 8B, and 8C show an LED bulb that emits a plurality of beams, some of which have special functions such as to provide power fail lighting, auto tracking, remote control, RF transmission, infrared transmission, and blue-tooth communications.
Figure 8B:
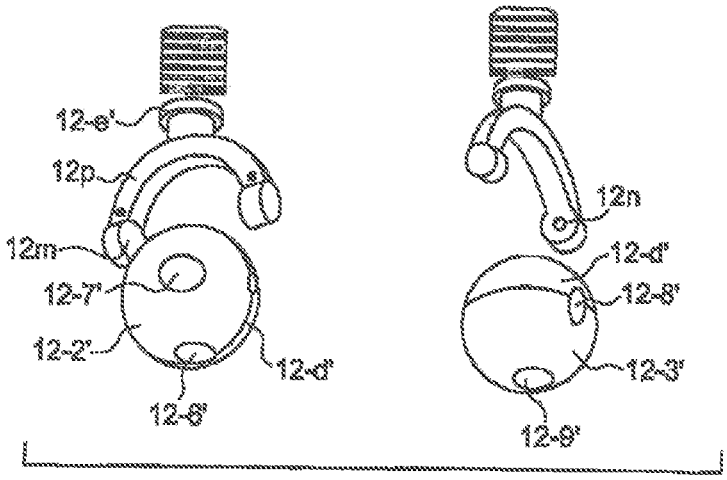
Figure 8C:
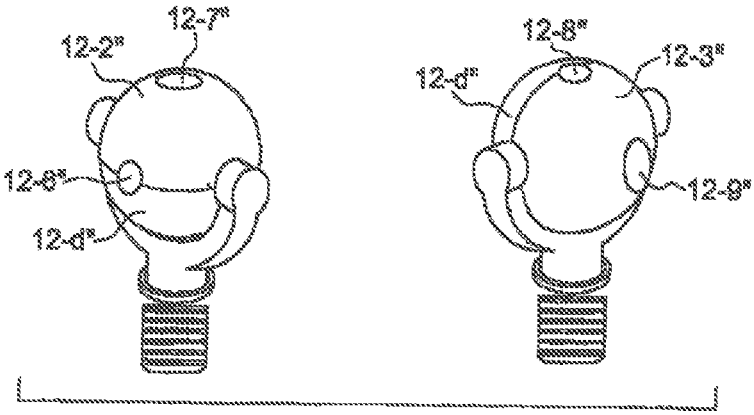

FIGS. 8A to 8C show an LED bulb from which a plurality of light beams are emitted, with different LED light beams having special functions such as a power fail illumination function, auto tracking, remote control, RF transmission/reception, infrared emission, blue-tooth communications, and so forth.

From FIGS. 8A to 8C show the LED bulb (12*d*) has different number of project assembly (12*d*) 12-6') (12-7') (12-8')(12-9') (12-6"0 (12-7") (12-8") (12-9") and the preferred embodiment of FIGS. 8A, 8B, 8C has rotating electric connection with frame (12*i*) (12*p*) (12*n*) so can make vertical rotating along the one axis, and the screw-in male base with the elastic contactor-pin so can make the horizon rotating so can aim the projection to desired location.

From FIGS. 8A to 8C show all the LED bulb without extendable tube which is a fixed project-assembly has desired optics-lens for projection purpose or optics-lens with treatment for creating the pattern to project from the openings. From FIGS. 8A to 8C also disclosure the each LED bulb can have more than one of project-assembly and project from none extendable project-assembly to near-by or-and far-away remote areas.

Figure 9:
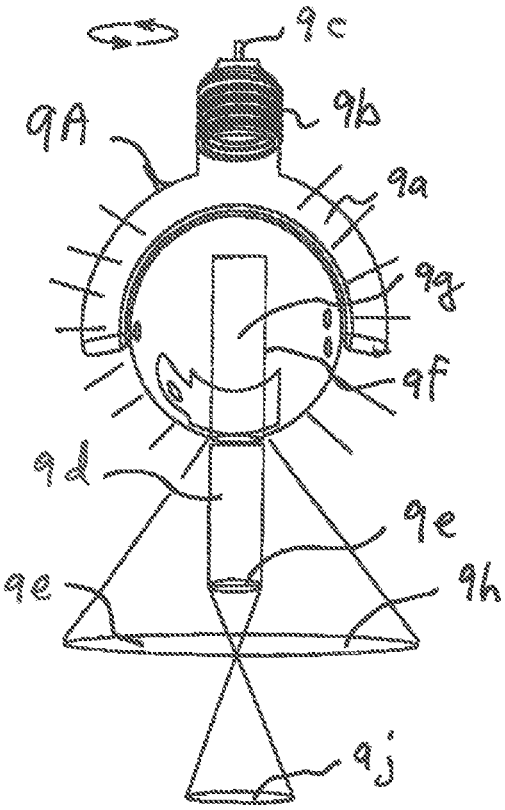
FIGS. 9 and 10 show other embodiments which have different geometric shapes of LED bulb and different rotating constructions to enable the LED light beams to be emitted to a certain position, and elastic contact points to overcome limitations of the rotating frame, rotating arms, or rotating base design. Also, these embodiments may emit light beams having different light performance or patterns through the use of focus adjustable means.
Figure 10:
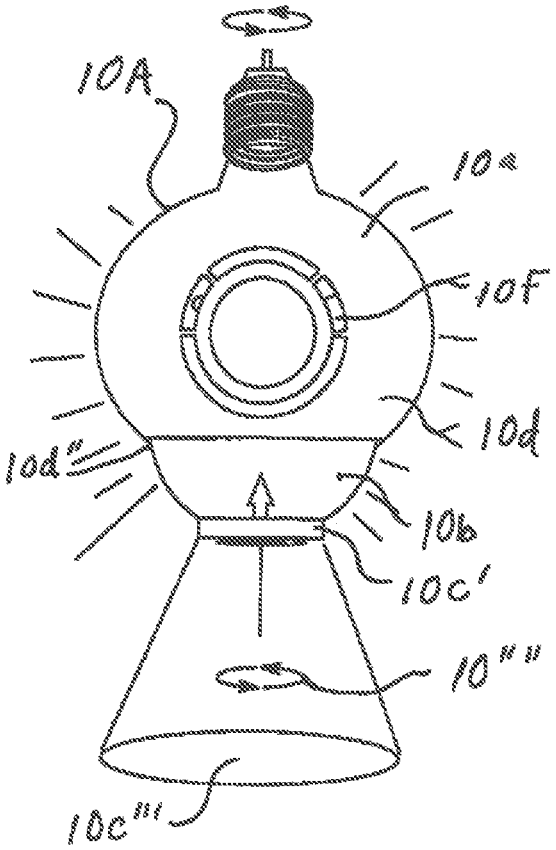

FIGS. 9 and 10 show other embodiments which have different geometric shapes of LED bulb and different rotating construction to cause the LED light beams to be emitted to a certain position and elastic contact points to help overcome limitations of the rotating frame, rotating arms, and rotating base design. Focus adjustment means enable one light beam to have different light performance or patterns.

From FIGS. 9 and 10 show other embodiment which show the LED bulb (9A) (10A) has any desired geometric shape and each may different shape, with frame (9*a*) or without frame (10*a*). but each one has project-assembly such as extendable project-assembly (9*g*) or fixed projection-assembly (10*c*') or extendable but with dome or sphere optics-lens projection-assembly. The said each of project assembly has built-in LEDs for desired type and project the light-beam or lighted image or lighted patterns (9*j*) (10*c*''') with rotating of the said light-beam or lighted image or lighted patterns (10*c*'''') for certain size basing on fixed focus-kit or adjustable focus-kits (not shown) but shown on earlier FIGS. 7A to 7D.

From FIGS. 9 and 10 show the said illumination is created by the built-in $2^{nd}$ LEDs and go through rotatable LED bulb (9*a*) or non-rotate LED bulb (10*a*) the LED bulb rest of areas except the project-assembly head area. The features of extendable project assembly has flat optics-lens (10*c*') to prevent the project light beam or illumination light beam interfere each other while people want to use only one functions.

Figure 11C:
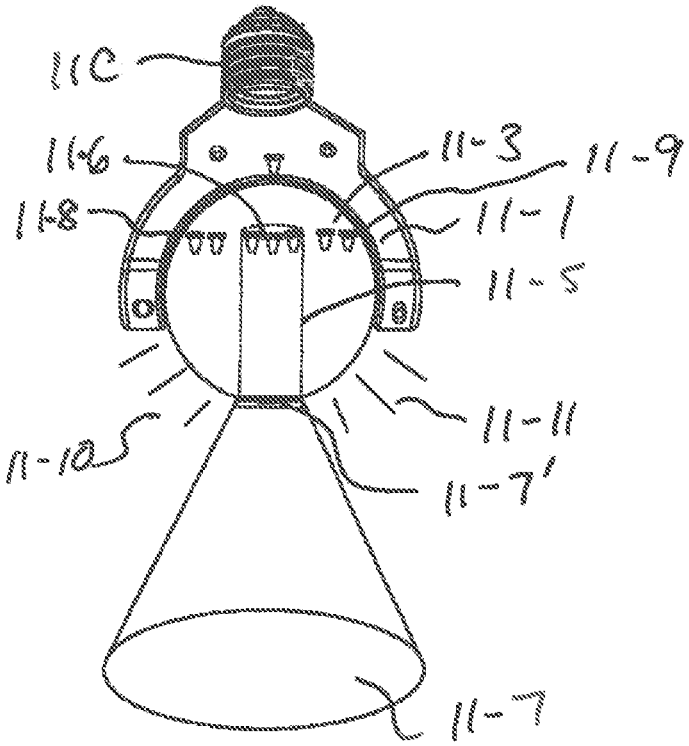

FIGS. 11A to 11C show a preferred embodiment which can offer nearby and remote area illumination or images at the same time. The plurality of LED light sources are arranged inside the projection assembly, telescope-tube means, tubular piece means, and extend or retractable piece means with preferred divider or housing parts or tube to isolated projection and illumination light beam to interfere each other and projected to provide the near-by or remote or faraway illumination or image Some of LEDs have a high power output while others have a low power output to offer the nearby illumination or images comparable to those of a conventional LED bulb or incandescent bulb. Hence, the current invention can use one single LED bulb to provide more than one area with illumination or images.

From FIGS. 11 A to 11C show the detail related the each injected unit LED bulb (11A) (11B) (11C) has frame (11*a*) with round shape LED bulb housing (11*d*) or without frame with traditional incandescent bulb shape (11*r*) or with frame (11-1) rotating round shape LED bulb housing (11-3). All these preferred embodiment only limited example which all alternative or equal functions or replaceable construction, concept, design should still fall within the current invention scope for projection and illumination LED bulb and can use switch to change LED light bulb functions as above discussed including light color, brightness, moving type, fade-in or fade-out, chasing, sequential, color changing, color selection, functions selection, dimmer control, wireless or remote control and other market available functions or light effects.

From FIGS. 11A to 11C show injected unit LED bulb (11A) (11B) (11C) the $1^{st}$ LED to offer the project assembly to project LED light beam, lighted patterns, lighted image to areas such as (11*m*) (11*y*) (11-7) through the projection optics-lens in desired size (11*j*) (11V), shape including flat (11*j*) or sphere (11*v*), texture (FIG. 4A), diamond cut (4*a*5), spiral line (not shown), inner $2^{nd}$ or more optics-lens (not shown), texture, bubble, variable thickness or other market available optics-properties. The said $1^{st}$ LED light source can be any type of LEDs or any number LEDs, or any color or assortment color for LED.

From FIG. 11A to 11C show the $2^{nd}$ group LED to offer the illumination and all the light beam go through the said rest areas of bulb housing except the areas of the project-assembly occupied, and form the illumination area (10*d*') (10*d*'') from $2^{nd}$ LED group install on the Circuit board (11*u*)(11*g*) and rotating optic-lens (11*v*) to make the said sphere or dome or round or at least ½ ball shape optics-lens to rotate to make the lighted-pattern or light-beam for moving or rotating or moving to create existing light functions, further can incorporate with IC circuit to make the at least one or more than one LED for sequential flashing or fade-in and fade-out to make color change, or automatically changing, or selected colors, freeze color, or selected functions or dimmer function or market available LED light function or effects or performance.

The said extendable project-assembly (11*v*) or said fixed project-assembly (11-6) need has divider (11*w*) or wall or housing-parts (11-4) or tube or holder or channels to make the each light beam is not interfere each other of the projection and illumination is other preferred construction of the current invention.

I claim:

1. A multiple function LED light device for providing image or lighted pattern projection, comprising:

at least one LED; and at least one projection lens for enlarging and projecting an image or lighted patterns from the at least one LED; at least one of a tube, tube assembly, or housing to prevent light beam leakage; and at least one image or pattern forming display selected from (a) an image or pattern forming element or optical lens, (b) a display device, (c) a slide or film, (d) a printed piece or cover, (e) a digital data display, or (f) an LCD display, to project at least one of:

(A) a light beam image, message, time, geometric image, art, movie, moving article or other visible items, (B) a pattern, image, movie or articles moved by a motor or movement device, and (C) a light pattern or image, formed by the light beams passing through at least one stationary or moving optic-lens or cover to create stationary or moving visual effects, and wherein the LED light device is (i) connected to an AC power source by conductors, or (ii) has a base insertable into a lamp holder for connecting the LED light device to the AC power source.

2. A multiple function LED light device for providing image or lighted pattern projection as claimed in claim 1, wherein the at least one LED includes a first LED and a second LED.

3. A multiple function LED light device for providing image or lighted pattern projection as claimed in claim 1, further comprising at least one other optics element for varying a light performance of the LED light device.

4. A multiple function LED light device for providing image or lighted pattern projection as claimed in claim 3, further comprising (a) a focus adjustment mechanism for adjusting a focus of a projected image or pattern or (b) at least one controller for varying a brightness, size, color changing or performance of the projected image or pattern.

5. A multiple function LED light device for providing image or lighted pattern projection as claimed in claim 1, wherein the base is a screw type, pin type, pole type, multiple pole type, twist type, or bayonet type light bulb base.

6. A multiple function LED light device having for providing image or lighted pattern projection as claimed in claim 1, wherein the LED light device has more than one said at least one LED and emits more than one set of light beams to illuminate more than one area or section away from or surrounding the LED light device.

7. A multiple function LED light device having for providing image or lighted pattern projection as claimed in claim 1, wherein LED light beams passing through desired combination of the (1) optical elements, lens, or (2) display unit, image forming sets, or (3) LCD display, Leos image, LCOS lens, or (4) digital display of the projection assembly; are emitted out of the LED light device to desired locations, positions, and areas has desired (a) light, or (b) lighted patterns, or (c) colors, or (d) color changing, or (e) moving images, or (f) changeable images as predetermined functions, performance, effects.

8. A multiple function LED light device for providing image or lighted pattern projection as claimed in claim 1, further comprising any of a sensor, switch, motion sensor, remote control, blue-tooth unit, Wi-Fi unit, and photo sensor incorporated with circuitry for causing the at least one LED to emit light so as to provide predetermined light functions, performance, and effects.

9. A multiple function LED light device for providing image or lighted pattern projection as claimed in claim 1, wherein the LED light device includes a focus or wireless receiving device construction that is extendable or retractable.

10. A multiple function LED light device for providing image or lighted pattern projection as claimed in claim 1, wherein the LED light device not only provides illumination for at least one of a nearby area and a remote area, but also incorporates additional functions including one of a motion sensor, remote control, Blue-tooth, and Wi-Fi function.

11. A multiple function LED bulb for providing illumination and image or lighted pattern projection, comprising;

at least one LED; and at least one housing or component that is movable to (I) move parts sensitive to heat away from the heat, (II) move the at least one housing or component away from at least one blocking item that interferes with light passage, or (III) move at least one blocking item that interferes with electric-signal transmission to ensure that the bulb provides desired light functions, projection pattern performance, projected images, or light beam traveling directions, wherein the LED bulb has a base insertable into a lamp holder for connecting the LED bulb to a power source, and wherein an image or patterns are created by film, slide, art, or treated lens within the at least one housing or component and not received wirelessly from an external medium.

12. An LED light, comprising:

at least a first LED and a second LED;

an assembly for enlarging or projecting big light patterns or images from the first LED to a nearby or remote area, the assembly including the first LED, a projection lens, and an image display or at least one optical element with a treatment that creates at least one lighted image or pattern; and at least one of a tube or housing to prevent light leakage;

wherein light beams from the first LED pass through the image display before being projected through the projection lens to an area, wherein the optical element or display unit includes (I) an image or pattern forming element, (II) a digital data display, (III) an LCD display, slide, film, or printed piece, or (IV) at least one optics-lens or cover having at least one of a reflective or refractive function, for forming said light beam patterns or images, and wherein the LED light has parts incorporated with the first or second LED, the display, or the optical lens for causing the light patterns or images to move, the parts including a motor, movement device, stencil, openings, or windows with an art design, wherein light beams from said second LED are emitted or projected to a nearby area, at least one second remote area, or more than one nearby or remote area;

wherein the LED light is connected to a power source by conductive wires or has a base insertable into a lamp holder for connecting the LED bulb to a power source, and wherein the LED light has at least one of circuitry and a built-in or outside control system including at least one switch, sensor, blue-tooth unit, remote control unit, or wireless controller unit for providing predetermined light functions.

13. An LED bulb, comprising:

at least one first LED and at least one second LED; and at least one display unit, treated optics lens, or protective lens for UV protection or water resistance, through which light beams from at least one of the first and second LED pass before being projected through a projection lens to an area, wherein the at least one first LED has a white color or multiple colors to project or offer illumination for desired areas, wherein the at least one second LED include at least one multiple-color LED or multiple colored LEDs to project or offer illumination for the desired areas, wherein the LED bulb has or in incorporated with circuitry and a control system which has at least one of a (I) remote controller, or (II) Wi-Fi controller, or (III) Bluetooth controller, or (IV) power on-off or function-changing switch or (V) integrated circuit (IC), or (VI) wireless controller, or (VII) control circuitry or a control switch to control or change desired colors or light functions, wherein the white color LED, multiple-color LED, or multiple colored LEDs are controlled by the control system, and wherein the LED bulb is connected to a power source by conductive wires or has a base insertable into a lamp holder for connecting the LED bulb to a power source.

14. An LED bulb, comprising:

at least one first LED and at least one second LED; and at least one display unit, treated optics lens, or protective lens for UV protection or water resistance, through which light beams from at least one of the first and second LED pass before being projected through a projection lens to an area, wherein the at least one first LED is: (I) a white color LED to project or offer illumination for at least one desired area, or (II) includes a plurality of LEDs having different colors or a multiple-color LED to offer multiple color or color changing light functions to desired areas, wherein the white color LED, multiple-color LED, or multiple colored LEDs are controlled by the control system, wherein the LED bulb is connected to a power source by conductive wires or has a base insertable into a lamp holder, and wherein the LED bulb has or is incorporated with at least one of circuitry and a controller selected from a switch, sensor, integrated circuit (IC), Blue-tooth unit, remote control, or wireless controller unit to provide or change illumination or light projection functions of the LED bulb.

* * * * *